US008690205B2

(12) United States Patent
Benitez et al.

(10) Patent No.: US 8,690,205 B2
(45) Date of Patent: Apr. 8, 2014

(54) DOOR LOCKSET

(75) Inventors: Anthony Benitez, Loudon, TN (US); Scott G. Morstatt, Maryville, TN (US)

(73) Assignee: Yale Security Inc., Monroe, NC (US)

( * ) Notice: Subject to any disclaimer, the term of this patent is extended or adjusted under 35 U.S.C. 154(b) by 388 days.

(21) Appl. No.: 13/031,474

(22) Filed: Feb. 21, 2011

(65) Prior Publication Data

US 2012/0212001 A1 Aug. 23, 2012

(51) Int. Cl.
*E05B 1/00* (2006.01)
*E05B 3/00* (2006.01)

(52) U.S. Cl.
USPC ..... 292/347; 292/348; 70/224

(58) Field of Classification Search
USPC ..... 292/347–355; 70/224, 276, DIG. 59
See application file for complete search history.

(56) References Cited

U.S. PATENT DOCUMENTS

| | | | | |
|---|---|---|---|---|
| 1,708,138 A | | 4/1927 | Hildahl | |
| 3,284,593 A | | 11/1966 | Hawkins | |
| 3,668,579 A | | 6/1972 | Harman | |
| 4,073,527 A | * | 2/1978 | Schlage | 292/347 |
| 4,292,629 A | | 9/1981 | Kerr et al. | |
| 4,465,311 A | * | 8/1984 | Austin | 292/144 |
| 4,868,530 A | | 9/1989 | Ahs | |
| 4,956,983 A | * | 9/1990 | Okamura et al. | 70/241 |
| 5,202,580 A | * | 4/1993 | Janssen | 307/10.3 |
| 5,410,898 A | * | 5/1995 | Shieh | 70/276 |
| 5,543,767 A | | 8/1996 | Elenbaas | |
| 5,635,887 A | | 6/1997 | Fischette et al. | |
| 5,723,835 A | | 3/1998 | Gilmore | |
| 5,880,659 A | | 3/1999 | Woods | |
| 5,925,861 A | | 7/1999 | Fromberg | |
| 5,977,873 A | | 11/1999 | Woods | |
| 6,363,763 B1 | | 4/2002 | Geringer et al. | |
| 6,441,735 B1 | | 8/2002 | Marko et al. | |

(Continued)

FOREIGN PATENT DOCUMENTS

| | | |
|---|---|---|
| CA | 1248157 | 1/1989 |
| DE | 1982767 U | 4/1968 |

(Continued)

OTHER PUBLICATIONS

European Patent Office, International Search Report and Written Opinion of International Searching Authority for International Application No. PCT/US2012/025786 dated Jul. 24, 2012.

(Continued)

*Primary Examiner* — Carlos Lugo
(74) *Attorney, Agent, or Firm* — Matthew W. Witsil; Moore & Van Allen PLLC

(57) ABSTRACT

A sensor assembly for generating a request to exit (REX) signal for a door lockset operable with a latch operator and a controller that can signal an alarm. In one embodiment, the sensor assembly includes a mounting member adapted to be in a fixed position in the door lockset, a rotatable member adapted to rotate in response to rotation of the latch operator, and a sensor mounted to the mounting member. The sensor is spaced from the rotatable member and is configured to detect rotation of the rotatable member. When the rotatable member is rotated corresponding to rotation of the latch operator, the sensor detects the rotation, and a switch in the sensor, which may be magnetic, is actuated, closing a circuit to send a REX signal to the controller. The sensor assembly may be associated with a chassis of the door lockset.

23 Claims, 16 Drawing Sheets

(56) References Cited

U.S. PATENT DOCUMENTS

| | | | | |
|---|---|---|---|---|
| 6,622,537 | B2 * | 9/2003 | Rodriguez | 70/432 |
| 6,681,607 | B2 | 1/2004 | Geringer | |
| 6,689,972 | B1 | 2/2004 | Frolov et al. | |
| 6,784,784 | B1 | 8/2004 | Zehrung | |
| 6,906,626 | B2 | 6/2005 | Novotny | |
| 6,967,562 | B2 * | 11/2005 | Menard et al. | 340/5.64 |
| 8,051,689 | B1 | 11/2011 | Shen et al. | |
| 2005/0044908 | A1 | 3/2005 | Min | |
| 2006/0059963 | A1 | 3/2006 | Conforti | |
| 2006/0192396 | A1 * | 8/2006 | Frolov et al. | 292/169 |
| 2006/0254330 | A1 | 11/2006 | Geringer et al. | |
| 2007/0126577 | A1 | 6/2007 | Cervantes et al. | |
| 2007/0176437 | A1 * | 8/2007 | Marschalek et al. | 292/347 |
| 2008/0209228 | A1 | 8/2008 | Chandler | |
| 2009/0051528 | A1 | 2/2009 | Graichen | |
| 2009/0152875 | A1 | 6/2009 | Gray et al. | |

FOREIGN PATENT DOCUMENTS

| | | | |
|---|---|---|---|
| DE | 3940457 | C1 | 3/1991 |
| DE | 4232809 | A1 | 5/1993 |
| DE | 19619210 | A1 | 11/1997 |
| DE | 10065100 | A1 | 7/2002 |
| DE | 20214861 | U1 | 1/2003 |
| DE | 10143608 | A1 | 3/2003 |
| DE | 202004002708 | U1 | 4/2004 |
| DE | 102004013029 | A1 | 10/2005 |
| EP | 0346317 | A2 | 12/1989 |
| EP | 0468514 | B1 | 10/1993 |
| EP | 0676518 | A2 | 10/1995 |
| EP | 1061213 | B1 | 6/2000 |
| EP | 1079055 | B1 | 7/2000 |
| EP | 1136963 | A1 | 9/2001 |
| FR | 2770305 | A1 | 4/1999 |
| GB | 2146063 | A | 4/1985 |
| JP | 62295749 | A | 12/1987 |
| JP | 1044596 | A | 2/1989 |
| JP | 6124630 | A | 5/1994 |
| JP | 2005155004 | A | 6/2005 |
| JP | 2006249716 | A | 9/2006 |
| WO | 9723851 | A1 | 7/1997 |
| WO | 2007025689 | A1 | 3/2007 |
| WO | 2007121817 | A1 | 11/2007 |
| WO | 2011022571 | A1 | 2/2011 |

OTHER PUBLICATIONS

The International Bureau of WIPO, International Application No. PCT/US2012/025786 International Preliminary Report on Patentability dated Aug. 29, 2013, pp. 1-8.

* cited by examiner

DOOR LOCKSET

BACKGROUND

Embodiments of lockset described herein relate generally to a lockset for use with a door, and more particularly to a lockset with a request to exit (REX) switch.

Door alarm systems may include an electronically controlled lockset in a door that receives a signal from a controller to unlock the door in response to a request to enter signal received from outside a secured area. A sensor may be provided that signals the controller when the door is opened. REX switches may be mounted in the door lockset to send a signal to the controller when a door is being opened from the inside. The REX signal overrides generation of an alarm signal by the controller that would otherwise occur in response to the door being opened without a valid credential approval. Known REX switches include electromechanical switches, such as microswitches, that are actuated by rotation of parts associated with an interior spindle. Such electromechanical switches may be actuated by depressing a button or lever arm with parts such as leaves or tabs, and are subject to breakage from repeated actuation over their life cycles. Wear that may cause the switch to malfunction may occur in the parts that actuate the switches as well.

For the foregoing reasons, there is a need for a new lockset with a REX switch that avoids failures that may be seen with electromechanical switches.

SUMMARY

In accordance with one embodiment, a sensor assembly for a door lockset operable with a latch operator and a controller is provided. The sensor assembly includes a mounting member adapted to be in a fixed position in the door lockset, a rotatable member adapted to rotate in response to rotation of the latch operator, and a sensor mounted to the mounting member. The sensor is spaced from the rotatable member and is configured to detect rotation of the rotatable member. In one embodiment, the rotatable member may be a hollow substantially cylindrical member including a wall defining a first void therethrough, and the mounting member may be a hollow member defining a substantially cylindrical opening and including a wall defining a second void therethrough. A portion of the rotatable member may be received in the mounting member substantially cylindrical opening and the first and second voids may be substantially in initial registration, and the sensor may be disposed in the second void. The sensor may be adapted to activate upon rotation of the rotatable member that results in the first void not being in registration with the second void and the wall of the rotatable member being detectable by the sensor.

In accordance with another embodiment, another sensor assembly for a door lockset operable with a latch operator and a controller is provided. The sensor assembly includes a rollback sleeve, an end cap, and a sensor. The rollback sleeve has a first end and a second end, includes a substantially cylindrical wall portion, and defines a void in the wall proximate to the first end. The rollback sleeve is adapted to be operatively connected to a door operator and to rotate upon rotation of the latch operator. The end cap receives the rollback sleeve, and includes a flange extending from a substantially cylindrical wall portion. The cylindrical wall portion of the end cap defines an opening that is in substantial initial registration with the void in the wall of the first rollback sleeve. The sensor is disposed in the opening in the wall of the end cap, and is adapted to activate upon rotation of the rollback sleeve that results in the opening in the wall of the end cap not being in registration with the void in the wall of the rollback sleeve and the wall of the rollback sleeve being detectable by the sensor.

In accordance with another embodiment, a chassis for a door lockset operable with latch operators on each side of a door and a controller a lockset assembly is provided. The chassis includes a housing having a first side and a second side opposite the first side. A retractor is disposed in the housing and includes a cam surface on each side. First and second rollback sleeves each have a first end and a second end, and each rollback sleeve includes a substantially cylindrical wall portion and camming elements extending from the first end of the cylindrical portion. The camming elements are engageable with the cam surfaces of the retractor. The first rollback sleeve defines a void in the wall proximate to the first end, and the first and second rollback sleeves are adapted for each to be operatively connected to a latch operator and to rotate upon rotation of the respective latch operator. A first end cap is mounted to the first side of the housing and receives the first rollback sleeve. The first end cap includes a flange extending from a substantially cylindrical wall portion, which defines an opening that is in initial registration with the void in the wall of the first rollback sleeve. A second end cap is mounted to the second side of the housing and receives the second rollback sleeve. The second end cap includes a flange extending from a substantially cylindrical wall portion. A sensor is disposed in the opening in the wall of the first end cap. The sensor is adapted to activate upon rotation of the first rollback sleeve that results in the opening in the wall of the first end cap not being in registration with the void in the wall of the first rollback sleeve and the wall of the first rollback sleeve being detectable by the sensor.

In accordance with another embodiment, a method of making a sensor assembly for a door lockset operable with a latch operator and a controller is provided. The method includes providing a mounting member adapted to be in a fixed position in the door lockset. A rotatable member is provided that is adapted to rotate in response to rotation of the latch operator. A sensor is mounted to the mounting member, spaced from the rotatable member, and is configured to detect rotation of the rotatable member.

In accordance with another embodiment, a method of generating a request to exit signal with a door lockset operable with a latch operator and a controller is provided. The door lockset includes a rollback sleeve, an end cap, and a sensor. The rollback sleeve has a first end and a second end, and including a substantially cylindrical wall portion while defining a void in the wall proximate to the first end. The rollback sleeve is adapted to be operatively connected to a door operator and to rotate upon rotation of the latch operator. The end cap receives the rollback sleeve and includes a flange extending from a substantially cylindrical wall portion that defines an opening in initial substantial registration with the void in the wall of the first rollback sleeve. The sensor is disposed in the opening in the wall of the end cap. The method includes actuating the sensor in response to a magnetic attraction of a component of the sensor to the rollback sleeve when the rollback sleeve is rotated to cause the wall of the rollback sleeve to be disposed in registration with the opening in the wall of the first end cap, and sending a request to exit signal to the controller.

BRIEF DESCRIPTION OF THE DRAWINGS

For a more complete understanding, reference should now be had to the embodiments shown in the accompanying drawings and described below. In the drawings:

FIG. 17 is a detailed side view of a portion of the REX sensor shown in FIG. 18.

DESCRIPTION

The embodiments of a REX assembly described herein may be for use in a conventional lockset such as, for example, the locksets described by U.S. Pat. No. 4,920,773 and U.S. Pat. No. 6,131,970, the contents of both of which are incorporated herein by reference. Moreover, it is understood that the overall construction of the lockset assembly is not critical and, for purposes of illustration, may be as described herein or in the above-referenced U.S. patents. Accordingly, although exemplary embodiments will be described in detail herein with respect to a REX assembly function, detailed explanations of the functioning of all of the lockset components are deemed unnecessary for understanding by one of ordinary skill in the art.

Certain terminology is used herein for convenience only and is not to be taken as a limitation. For example, words such as "upper," "lower," "left," "right," "horizontal," "vertical," "upward," and "downward" merely describe the configuration shown in the figures. The components may be oriented in any direction and the terminology, therefore, should be understood as encompassing such variations unless specified otherwise.

Figure 1:
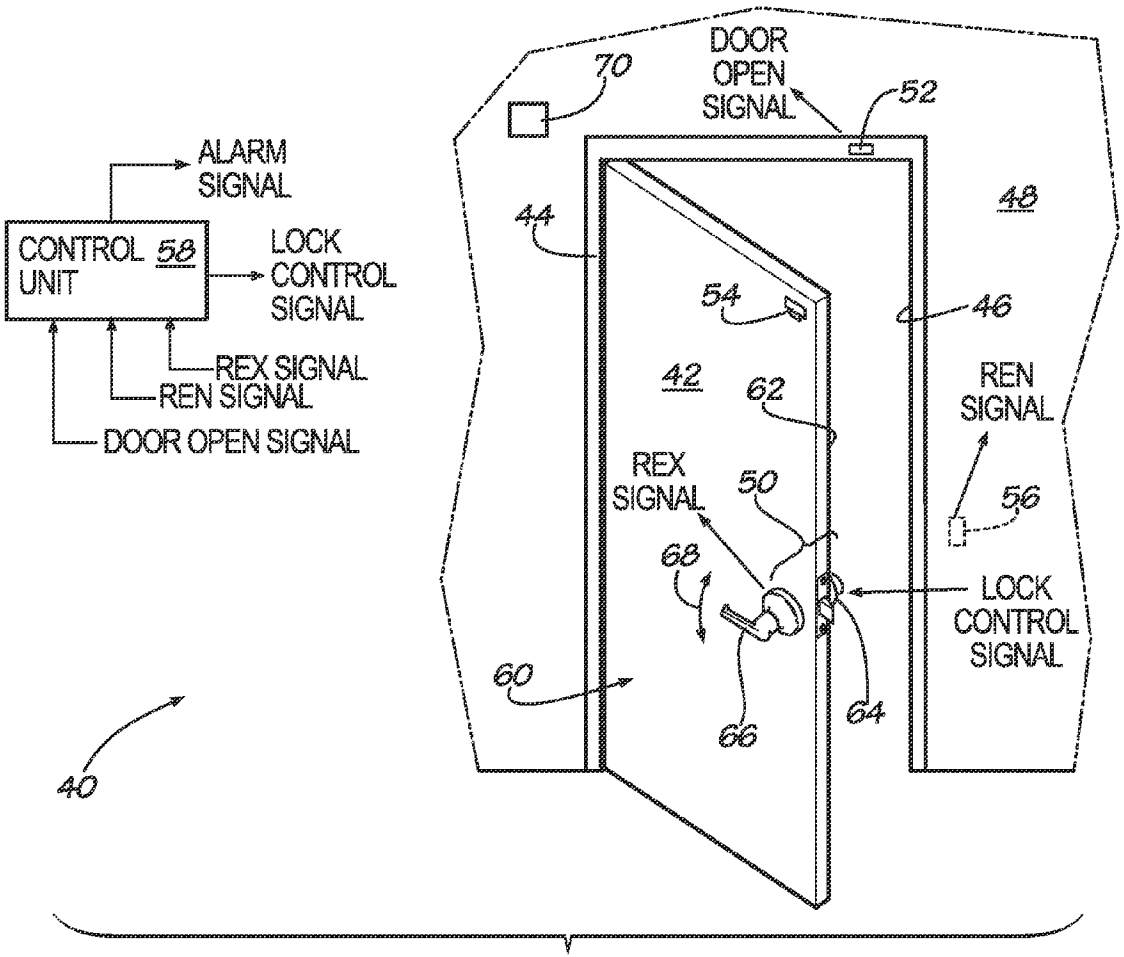
FIG. 1 is an exploded perspective view of a lockset assembly according to one embodiment of a lockset.

Referring now to the drawings, wherein like reference numerals designate corresponding or similar elements throughout the several views, an embodiment of a door alarm system for use with a conventional opening in a door is shown in FIG. 1 and generally designated at 40. The system 40 is applied to a door 42 pivotally mounted to a frame 44 at an opening 46 in a wall 48 and includes a door lockset assembly 50, a door detector 52, a door position indicator 54, an entry request device 56, and a control unit 58. The door detector 52 generates an open door signal when the door 42 is open. The open door signal is transmitted in either a wired or a wireless form to the control unit 58. Alternatively, the door detector 52 could generate a closed door signal when the door 42 is closed. Some components and configuration of a door alarm system, excluding features including but not limited to the door lockset assembly disclosed herein, are disclosed in U.S. Pat. No. 6,784,784, issued Aug. 31, 2004, the entire contents of which are incorporated herein by reference.

In one embodiment, the door detector 52 may be a reed switch and the door position indicator 54 may be a magnet. The reed switch may be mounted into a door jamb of the frame 44 for the door 42 on the face of the door jamb on the interior side 60 of the door. The magnet may be mounted into an edge of the door 42 or to the inside face of the door. The reed switch can be either normally open or normally closed. When the door 42 is open, the reed switch has its normal state indicative that the door 42 is open. When the door 42 is closed, the magnet induces the reed switch to take its actuated state, indicating that the door 42 is closed. The door open signal may use electrical power from the control unit 58 or from a power supply that is local to the door detector 52 for indicating the normal or actuated state of the reed switch to indicate that the door is open or closed. Alternative embodiments and positions of the door detector 52 and door position indicator 54 will be apparent to those of ordinary skill in the art. In one such alternative embodiment, the door position indicator 54 may be a mount on the top edge of the door 42 for actuating a mechanical switch in the door detector 52. In another alternative embodiment, the door detector 52 may use an infrared signal generator and detector mounted in the door jamb and an infrared reflector mounted in edge of the door 42. In another alternative embodiment, the door detector 52 may use a microwave signal generator and detector mounted in the door jamb and the door position indicator 54 may be a microwave harmonic generator mounted in the edge of the door 42. The microwave generator generates a microwave signal triggering the harmonic generator to generate harmonics of the microwave signal, and the door detector 52 detects the harmonics at close range.

The entry request device 56 is mounted so that it is accessible from an exterior side 62 of the door 42 for enabling a user to request that the door 42 be unlocked to allow opening of the door 42 to enter a secured area. The entry request device 56 responds to the user request by issuing a request to enter (REN) signal in either a wired or a wireless form to the control unit 58. Embodiments of the entry request device 56 include but are not limited to card readers, keypads for authorization code entry, mechanical key mechanisms, and biometric devices. Alternative embodiments of the entry request device 56 will be apparent to those of ordinary skill in the art. The REN signal includes the authorization code for verification by the control unit 58. When the control unit 58 receives the REN signal from the entry request device 56, it tests the authorization code for validity. When the authorization code is valid, the control unit 58 issues a lock control signal to the door lockset assembly 50 to unlock the door 42.

The door 42 is locked and unlocked by the door lockset assembly 50 in response to the lock control signal that is received in a wired or wireless form from the control unit 58. The door lockset assembly 50 and the lock control signal can be implemented as fail secure where the door 42 is normally locked and the lock control signal supplies power to unlock the door 42 or as fail safe where the door 42 is normally unlocked and the lock control signal supplies power to lock the door 42.

The door lockset assembly 50 includes an exterior handle 64 on the exterior side 62 of the door 42 and an interior handle 66 on an interior side 60 of the door 42. When the door lockset assembly 50 unlocks the door 42, a user can use the exterior handle 64 to unlatch and open the door 42 and enter the area secured by the door 42.

The door lockset assembly 50 includes a REX switch. When the interior handle 66 is rotated 68, the door lockset assembly 50 unlatches the door 42 and enables the user to open the door 42 and exit from the area secured by the door 42. In response to the rotation 68 of the interior handle 66, the REX switch issues a REX signal in either a wired or wireless form to the control unit 58.

An alarm signal is generated by the control unit 58 when the door open signal from the door detector 52 indicates that the door 42 is open, unless either the alarm 70 is shunted by the REN signal with a valid authorization code for unlocking the door 42 for entering the secured area, or by the REX signal for exiting the secured area. The power for the door open signal, the REN signal, and the REX signal can be supplied locally or from the control unit 58.

Figure 2:
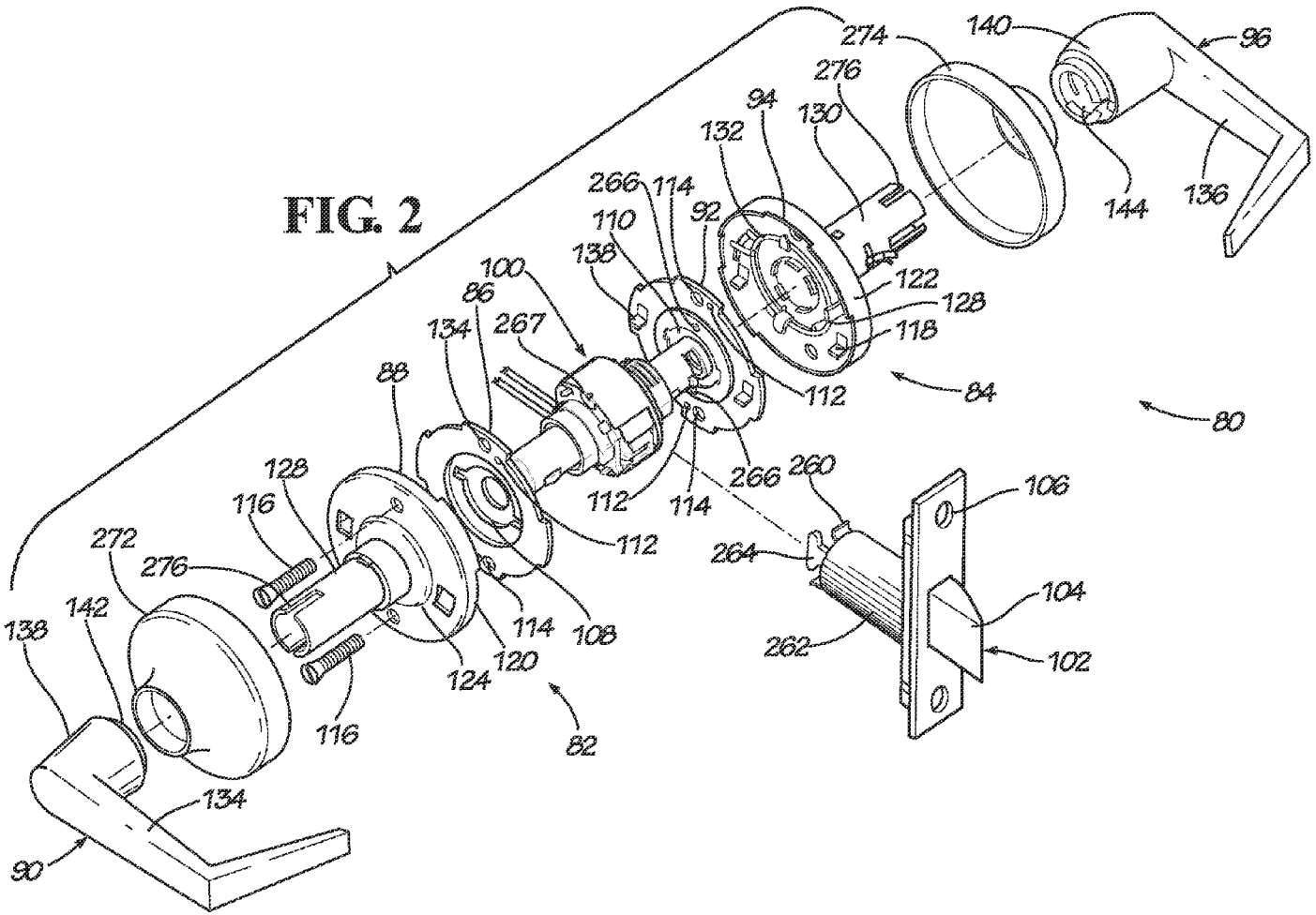
FIG. 2 is a schematic drawing of one configuration of a controller and door to be used with the lockset of FIG. 1.
Figure 3:
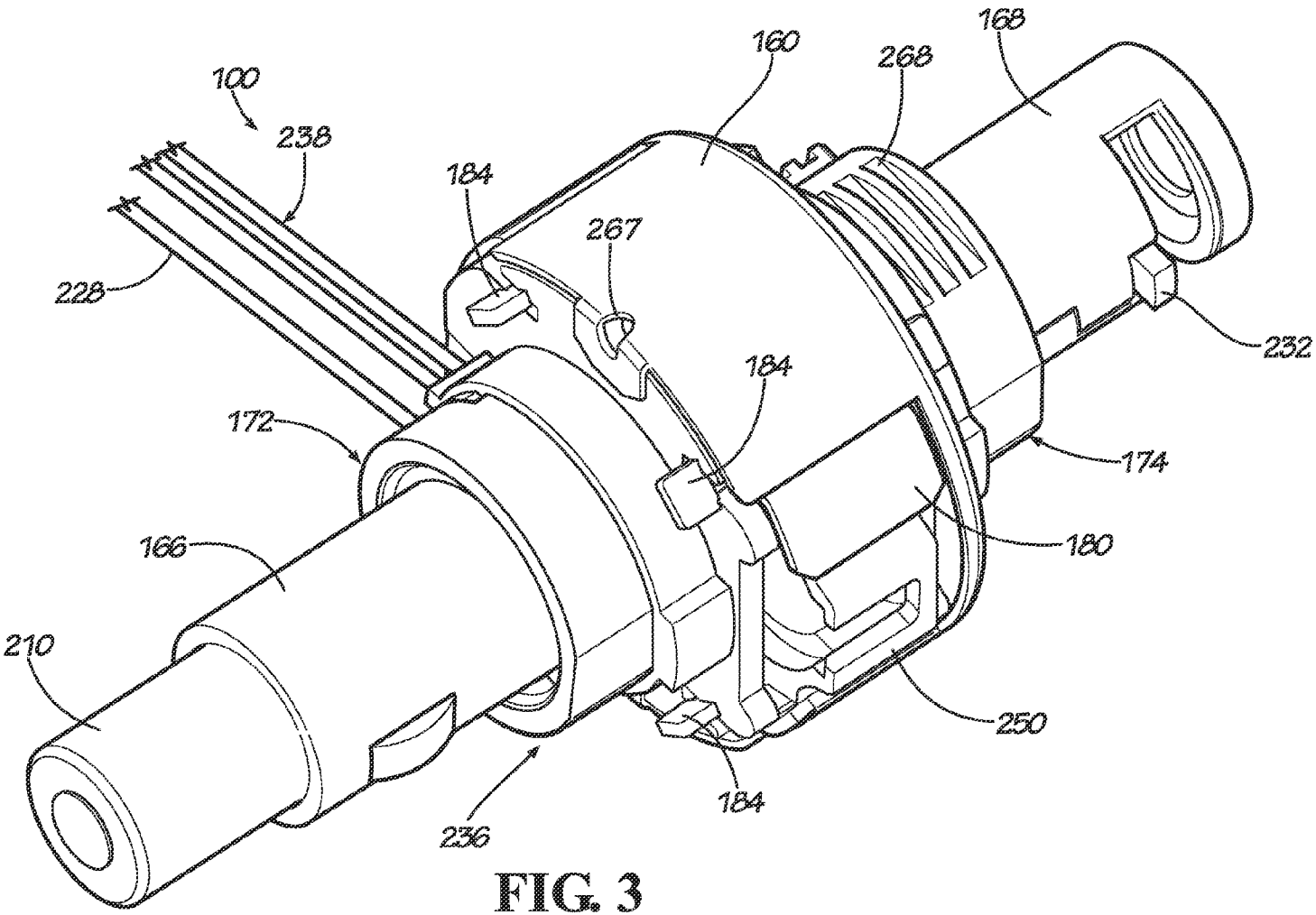
FIG. 3 is a front perspective view of the chassis assembly shown in FIG. 2.

FIG. 2 shows a cylindrical lockset assembly 80 for use as the door lockset assembly 50 with door alarm systems such as the system 40 shown in FIG. 1, or other systems as known by one of ordinary skill in the art. The cylindrical lockset assembly 80 comprises an inside subassembly 82 and an outside subassembly 84. The inside subassembly 82 includes a rose plate 86, a rose 88, and a lever 90. The outside subassembly 84 likewise includes a rose plate 92, a rose 94, and a lever 96. A chassis 100 is located between the inside subassembly 82 and the outside subassembly 84. A latch assembly 102 is positioned for operable attachment to the chassis 100 and includes a latchbolt 104 that extends outwardly from a face plate 106 in an extended, or latched, position.

The rose plates 86, 92 are each formed in a generally circular configuration and having an axial central opening 108, 110. Two pairs of holes 112, 114 are formed on the periphery of each rose plate 86, 92. One pair of holes 112 is adapted to pass bolts 116 which extend through the door. The other pair of holes is provided for receiving screws (not shown) for fastening the rose plates 86, 92 to their respective roses 88, 94. A pair of inwardly extending tabs 118 is formed in the outside rose plate 92 by punching holes through the outside rose plate 32.

The roses 88, 94 are each formed in a generally circular configuration and include a side wall 120, 122 defining an inner dish-like cavity in the inside surface of the rose 88, 94. An axial opening 124, 126 is formed through each rose 88, 94 and extends through rotating spindles 126, 130 which extend outwardly from the roses. A return spring 132 is positioned in the cavity of each rose 88, 94. As described above, the rose plates 86, 92 are fastened to the roses 88, 94 using screws for retaining the springs 132 within the cavity.

The levers 90, 96 each include a handle 134, 136 which is formed integrally with a hub 138, 140. Each hub 138, 140 has an axial opening 142, 144 which, in a locking lockset, may communicate with an axial opening formed through the handle for receiving a turn button or lock cylinder for locking of the latchbolt in the extended, or latched, position. Further, although levers are shown, it is understood that other latch operating means are suitable, such as a doorknob or the like.

Referring now to FIGS. 3-6, the chassis 100 comprises a shell 160 around a housing for accommodating a U-shaped retractor 164 and opposed rollback sleeves 166, 168. The housing includes a case 170 and opposed end caps 172, 174. The case 170 is formed in a U-shaped configuration having a base 176 and a pair of legs 178 formed integrally with the base 176. The legs 178 have inwardly bent ends 180. Two pairs of opposed tabs 184 extend transversely from each leg 178.

The end caps 172, 174 are generally circular and have a central axial opening 186, 188 that extends through a substantially cylindrical portion 190, 192 with a flange 194, 196 at one end. Four spaced notches 198 are formed in each of the end caps 172, 174 for receiving the tabs 184 on the case 170.

Figure 4:
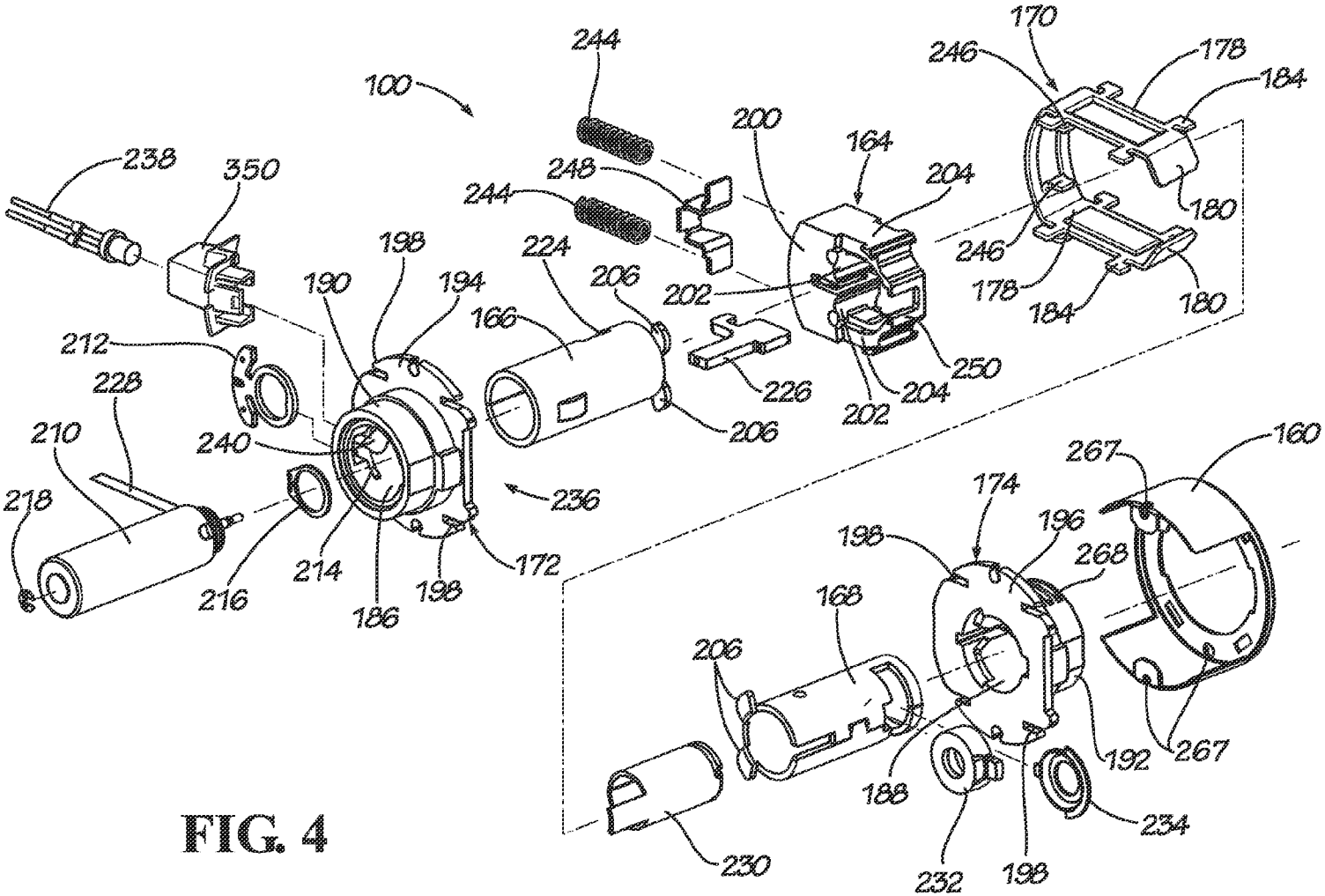
FIG. 4 is a front perspective exploded view of the chassis assembly shown in FIG. 2.
Figure 5:
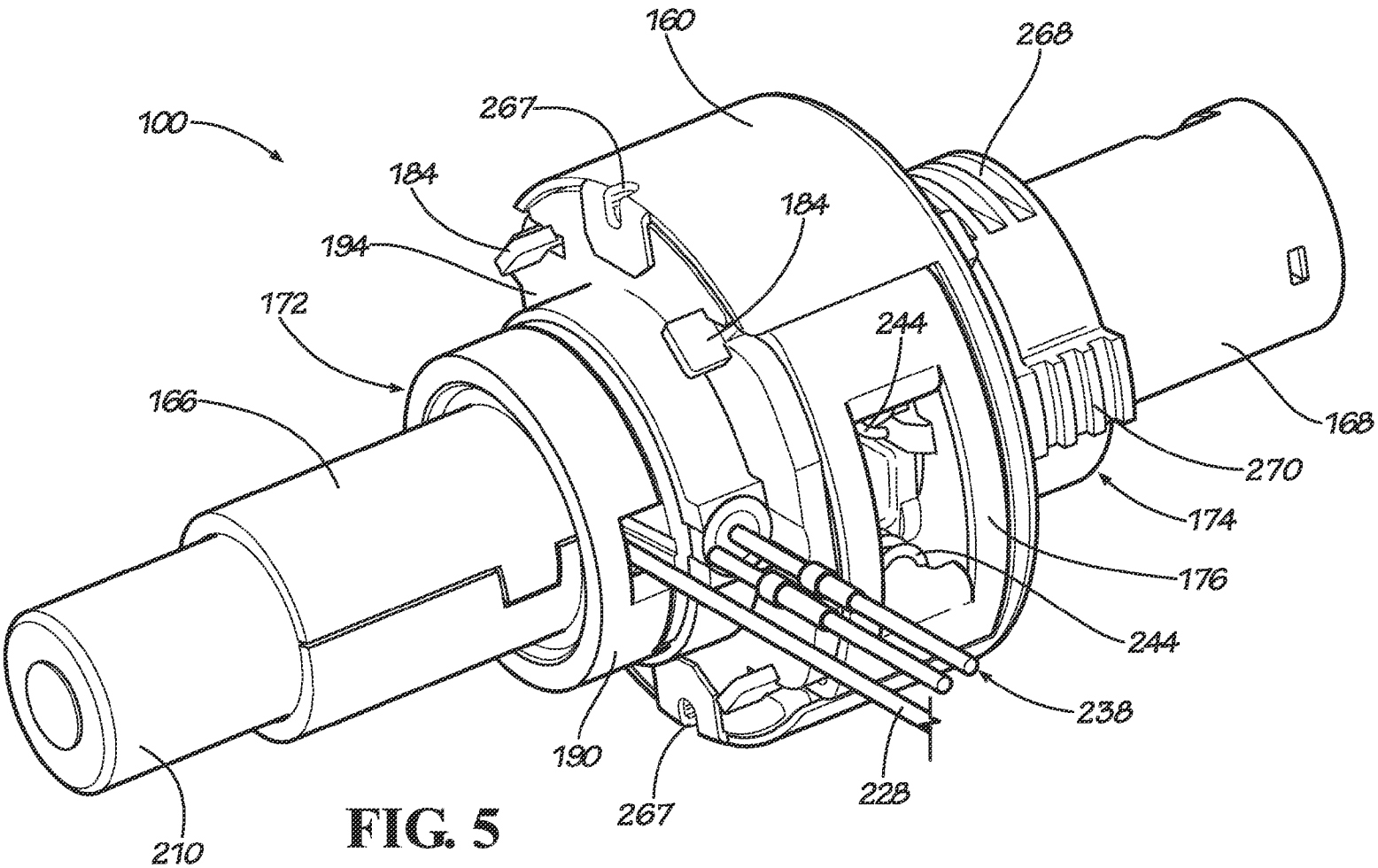
FIG. 5 is a rear perspective view of the chassis assembly shown in FIG. 2.
Figure 6:
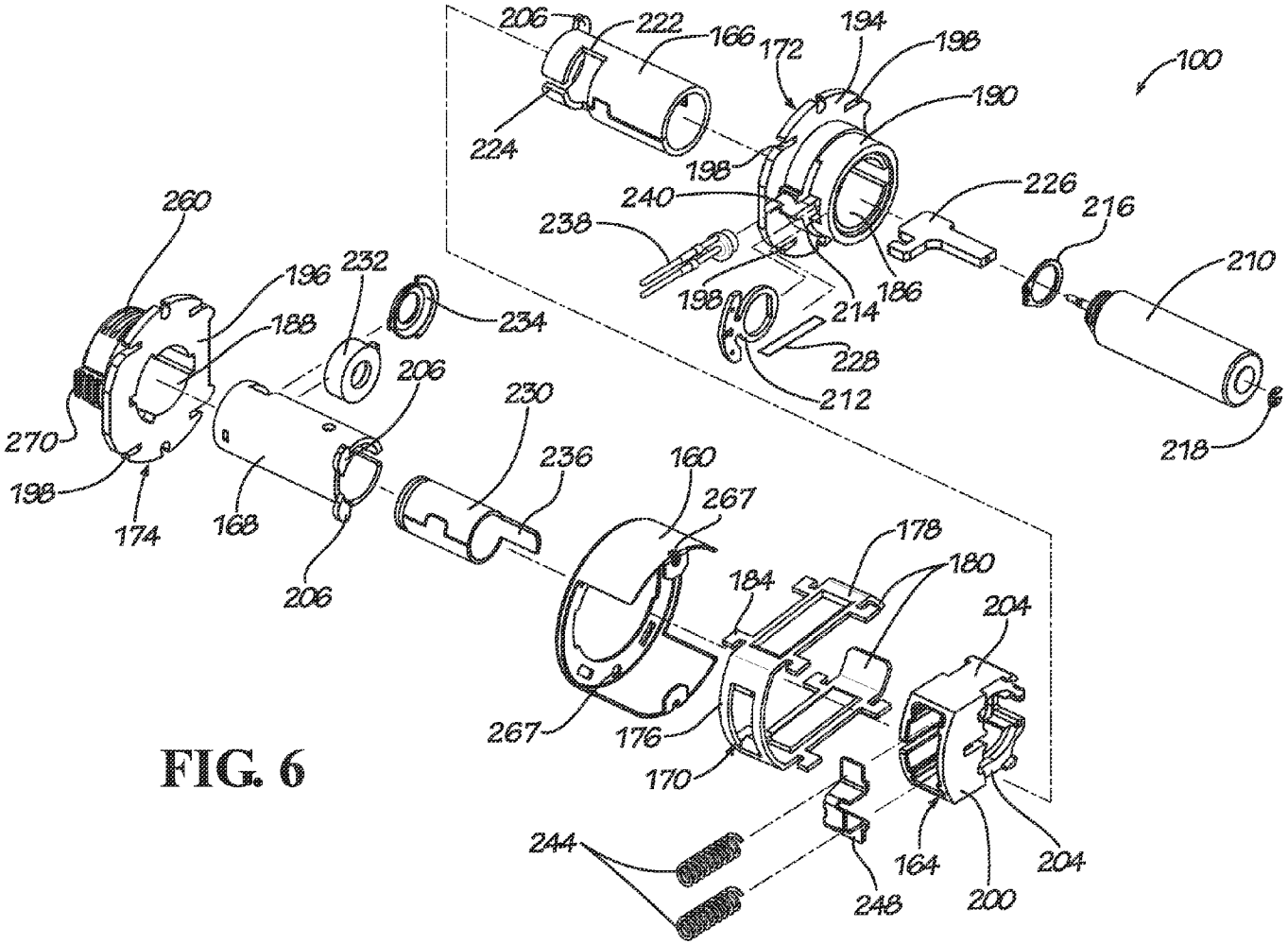
FIG. 6 is a rear perspective exploded view of the chassis assembly shown in FIG. 2.
Figure 8:
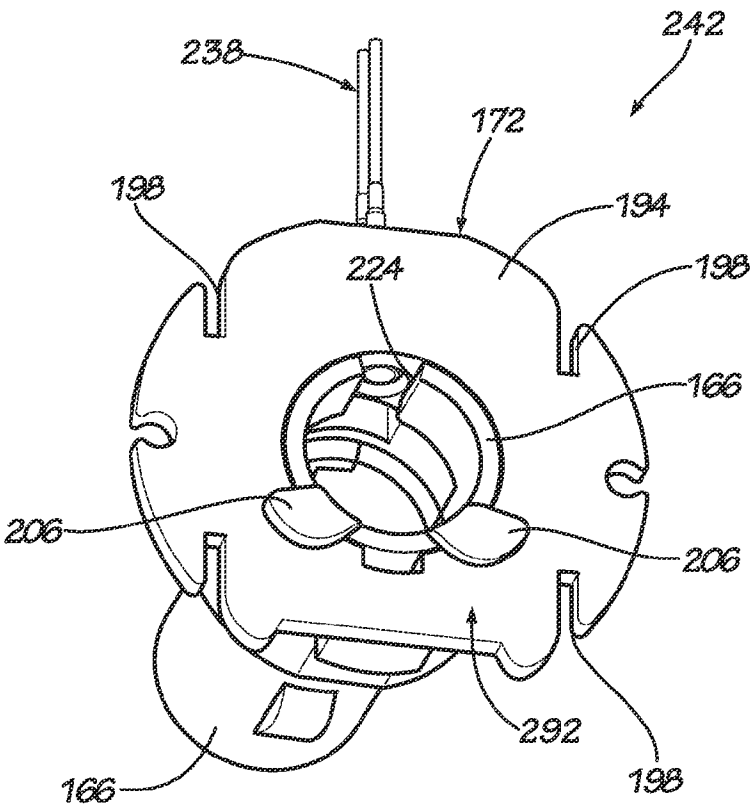
FIG. 8 is another perspective view of the REX assembly shown in FIG. 7.
Figure 7:
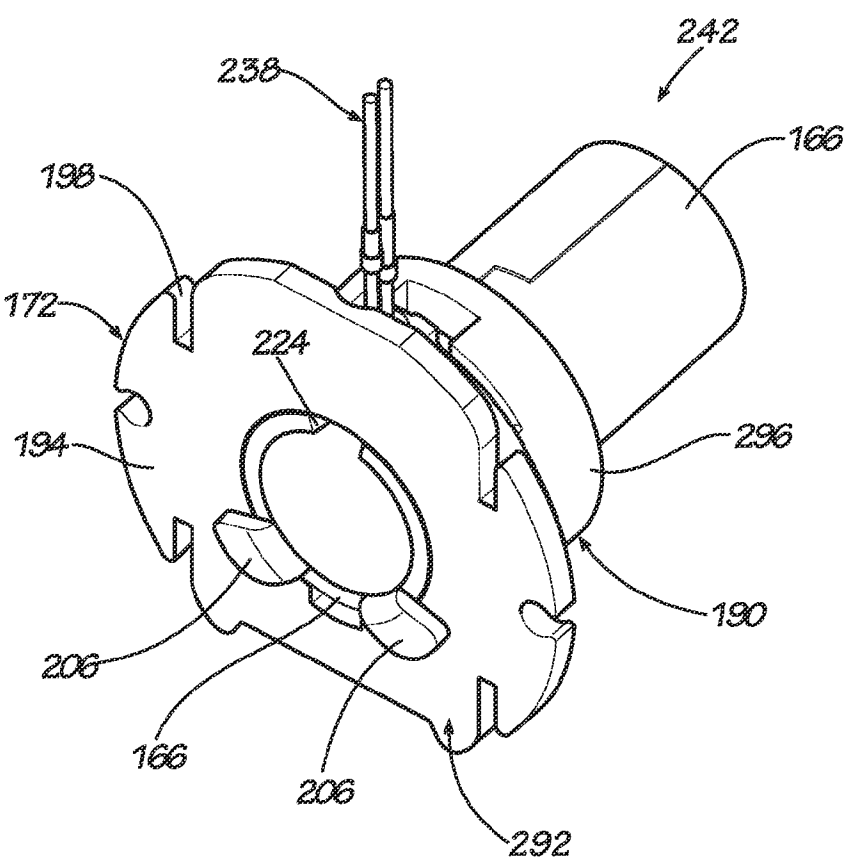
FIG. 7 is a perspective view of an embodiment of a REX assembly as part of the chassis assembly shown in FIG. 2.

The retractor 164 is formed with a base 200 having a cam surface 202 on each side and a pair of spaced, parallel arms 204. The sleeves 166, 168 are each formed with a pair of camming elements 206 at one end as shown in FIG. 4. The camming elements 206 are formed by rolling back portions of the sleeves 166, 168 which extend from the end of the cylindrical portions 190, 192 of the end caps 172, 174. The sleeves 166, 168 are rotatably received in the openings 186, 188 in the end caps 172, 174 as shown in FIGS. 3-6.

Additional features include the lock components, which include a solenoid 210 disposed in the inside rollback sleeve 166, a solenoid support 212 that extends laterally through an opening 214 in the inside end cap 172 to encircle the solenoid 210 and hold it in place, and a large retention clip 216 that affixes the solenoid 210 to the solenoid support 212. A small retention clip 218 acts as a stop for the solenoid pin axial movement. A lateral slot 222 in wall of the inside rollback sleeve 166 allows the inside rollback sleeve 166 to rotate around the solenoid 210 and solenoid support 212 without turning the solenoid 210. Another smaller slot 224 (FIG. 6) may be centered on the lateral slot 222 and extend from the lateral slot 222 to the proximate end of the inside rollback sleeve 166. A lock element 226 extends into the retractor 164 when the solenoid 210 is extended to prevent rotation of the outside latch operator by blocking the camming elements 206. The solenoid 210 may either be extended as the default condition (fail secure, with the door 42 is normally locked and power is supplied to unlock the door 42) or retracted as the default condition (fail safe, where the door 42 is normally unlocked and power is supplied to lock the door 42). An electrical wire 228 is provided to power the solenoid.

On the outside of the lock are a release tube 230, pawl 232, and spring seat 234. The release tube 230 receives a tail piece from the key cylinder that is on the outside lever (not shown). When a person outside rotates the key, it will rotate the tail piece, which will interact with the release tube 230. A finger 236 on the release tube 230 pushes retractor 164 in the same manner as the camming elements 206. The pawl 232 is either in or adjacent to a notch 237 (FIG. 4) in the opening of the outside rollback sleeve 168. When the pawl is out of the notch 237, the outside lever is in freewheel state and cannot rotate the outside rollback sleeve 168, which would push retractor 164 with camming elements 206. When the solenoid 210 is activated it retracts the lock element 226, which was making contact with the release tube 230. The pawl 232, being pushed by release tube 230, moves into the notch 237 while being pushed by a spring (not shown) between the pawl 232 and the spring seat 234. The outside lever rotates the pawl 232, which rotates sleeve 168 to move the retractor 164.

The embodiment of a REX assembly that is shown includes the inside end cap 172, the inside rollback sleeve 166, and a REX switch 238 disposed in an opening 240 through the wall of the inside end cap 172. In assembling the components of the chassis 100, the rollback sleeves 166, 168 are positioned so that the camming elements 206 are located adjacent the cam surfaces 202 on each side of the retractor 164. The sleeves 166, 168 and retractor 164 are then located in the case 170 between the legs 178 and close to the inner surface of the base 176. The ends of two springs 244 are positioned over a pair of spaced posts 246 extending outwardly from the base 176 of the case 170. The other ends of the springs 244 engage a retainer 248, which fits in a corresponding opening in the rear of the retractor 164 thereby placing the springs 244 in a contained position for subsequent compression. To complete the housing, the end caps 172, 174 are then slipped over the sleeves 166, 168 with the tabs 184 on the case 170 being inserted in the notches 198 in the end caps 172, 174 and twisted. The retractor 164, the inward ends of the sleeves 166, 168, the springs 244, and the retainer 248 are contained within the housing. The sleeves 166, 168 extend outwardly from the openings 186, 188 in the end caps 172, 174. In this arrangement, the lips 250 of the retractor 164 are exposed through the housing.

To assemble the latch assembly 102 to the chassis 100, ears 260 extending from the rear of the latch case 262 (FIG. 2) are engaged behind the bent ends 180 of the legs 178 of the case 170 (FIG. 4). The bolt tail 264 may then be attached to the lips 250, and the face plate 106 is secured to the edge of the door 42.

Next, the outside rose plate 92 (FIG. 2) is slid over the outside end cap 174. Two pins (not shown) are inserted through the openings 266, 267 in the outside rose plate 92 and the shell 160 of the chassis 100, and are held in place by the bent tabs on the shell 160. As seen in FIG. 3-6, the outside end cap 174 has longitudinally-spaced lateral grooves 268 for receiving the outside rose plate 92. The rose plate 92 is adapted to be engaged in one of the three grooves 268 in the outside end cap 174 to accommodate different door thicknesses. The outside rose plate 92 has an oblong central opening 110. The oblong opening 110 has a larger portion of sufficient dimension to allow the rose plate 92 to fit over the outside end cap 174 of the latch housing. The oblong central opening 110 also has two opposed flats which define a narrower portion of the oblong central opening 110. This shape of the opening 110 allows the outside rose plate 92 to be assembled eccentrically with respect to the housing with the narrower portion of the oblong central opening 110 centered over the housing and the flats seated in one set of grooves 268. The outside rose plate 92 is thus aligned with the appropriate groove 268 in the end cap 174, the outermost groove for a thick door or the innermost groove for a thin door, and moved laterally to a concentric position with respect to the housing. Once the outside rose plate 92 is so engaged, the housing is fixed rotationally and axially with respect to the outside rose plate 92.

The outside end cap 174 of the housing also includes a slotted longitudinal rib 270 (FIGS. 5 and 6) and the oblong central opening 110 in the outside rose plate 92 includes opposed notches. The notches are adapted to receive the longitudinal rib 270 when the outside rose plate 92 is engaged in either of the sets of grooves 260 as described above. This configuration further strengthens the assembly against rotation of the outside rose plate 92 with respect to the housing.

The outside rose 94 fits against the outside rose plate 92. Openings in the outside rose plate 92 are aligned with threaded holes in the outside rose 94 for use with screws for securing the outside rose plate 92 to the outside rose 94.

The inside rose plate 86 is secured to the inside rose 88 and then moved over the inside end cap 172 and against the door surface. Bolt holes in the inside rose 88 are aligned with threaded bolt holes of the outside rose 94. The threaded ends of the bolts 116 are then passed through the unthreaded holes in the inside rose 88 and into the threaded holes of the outside rose 94. The bolts 116 are then tightened to draw the rose plates 86, 92 and roses 88, 94 to a secure assembled position on opposite sides of the door whereby the heads of the bolts 116 come to rest in countersunk holes in the outer face of the inside rose 88. It is noted that in attaching the roses 88, 94 in the manner described above, protrusions on the sleeves 166, 168 are aligned with corresponding slots (not shown) in the spindles 128, 130 such that the sleeves 166, 168 and spindles 128, 130 rotate together within the lockset assembly 80.

To complete the assembly, an inside rose scalp 272 is slipped over the inside spindle 128 and the inside rose 88 and the inside lever 90 is secured onto the inside spindle 128. Similarly, an outside rose scalp 274 is placed over the outside spindle 130 and the outside rose 94 and the outside lever 96 is secured onto the spindle 130. In attaching the levers 90, 96, the axial hub openings 142, 144 are positioned over the spindles 128, 130, which include a pair of diametrically opposed longitudinal slots 276. The slots 276 receive corresponding ribs formed in the levers 90, 96 to facilitate rotation of the spindles 128, 130 upon actuation of the levers 90, 96. The hub openings 142, 144 are also formed with transverse depressions and are positioned for alignment with transverse slots formed in spindles 128, 130. Spring-biased detents or catch plates (not shown) extend through the slots and into the depressions to retain the levers 90, 96 on the sleeves 166, 168.

Figure 12:
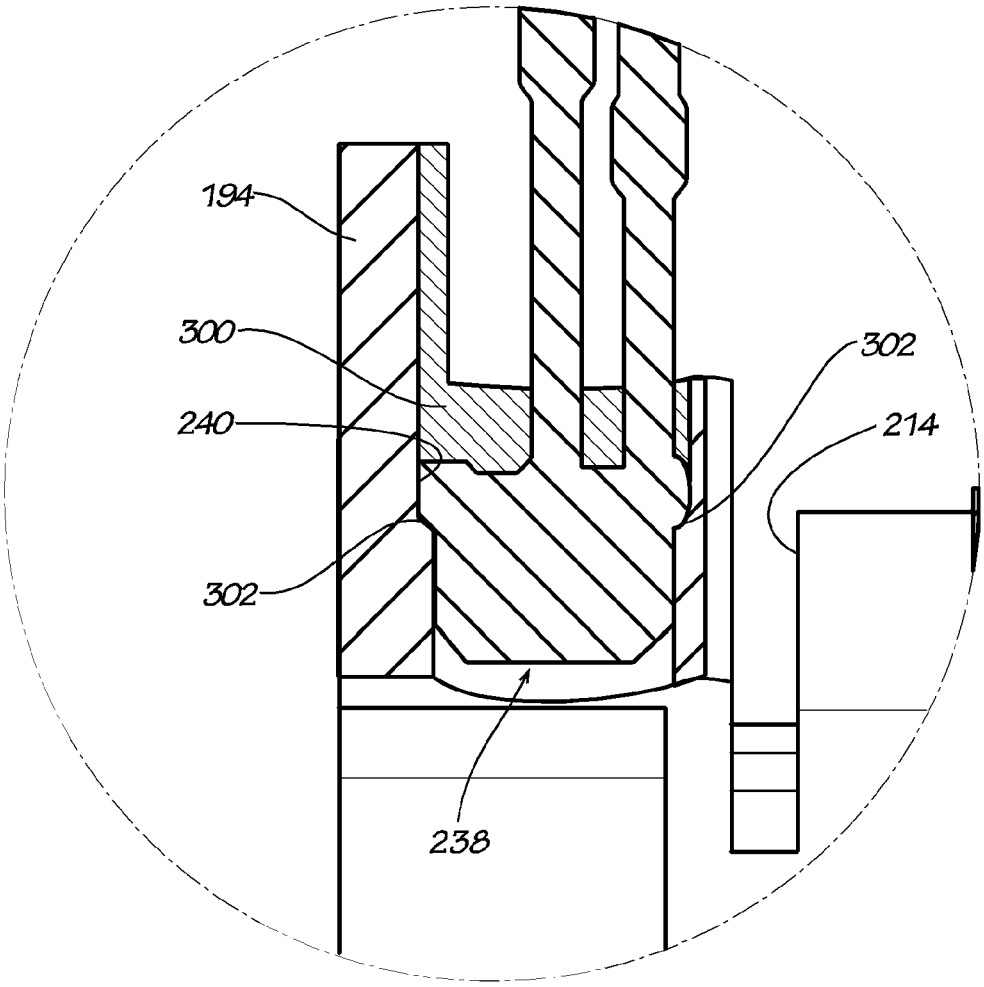
FIG. 12 is a detailed section view of a portion of the REX assembly as shown in FIG. 11.
Figure 14:
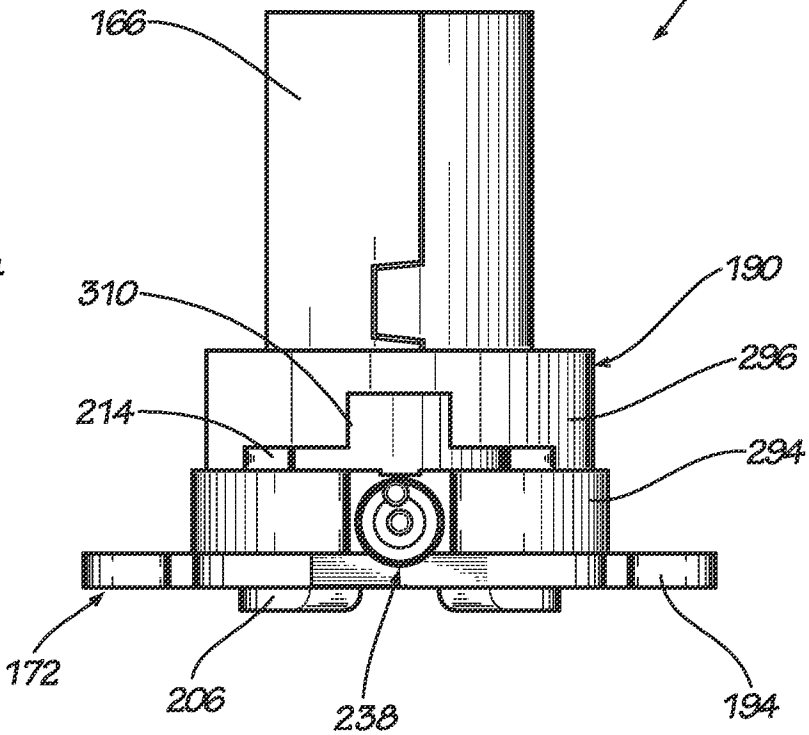
FIG. 14 is a top view of the REX assembly shown in FIG. 7.
Figure 13:
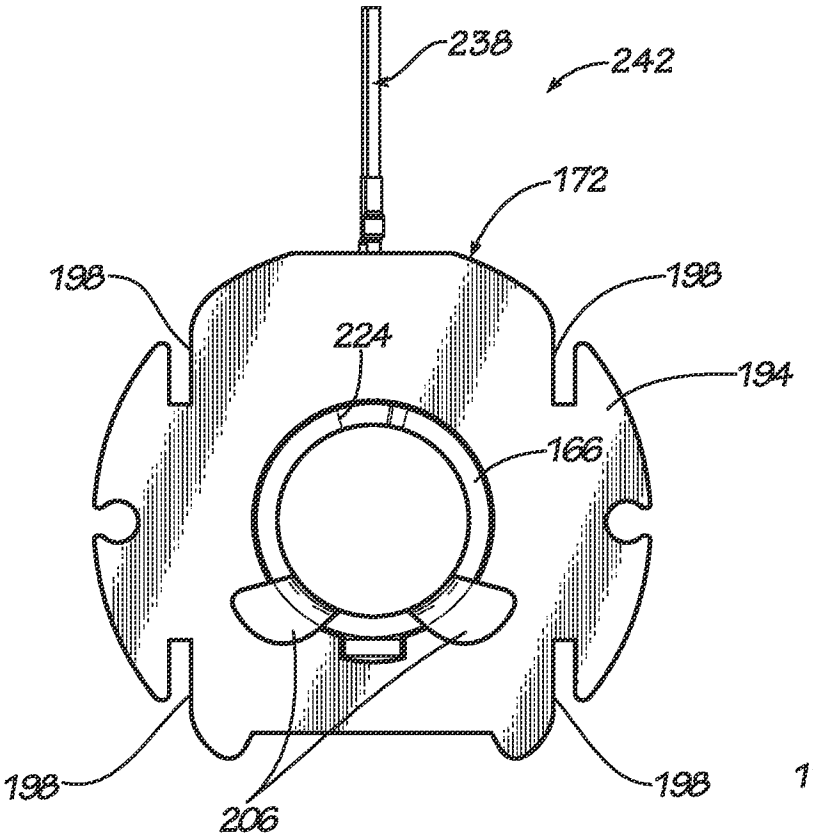
FIG. 13 is a front view of the REX assembly shown in FIG. 7.

FIGS. 7-14 show an embodiment of a REX assembly 242. As previously noted, the REX assembly 242 includes the inside end cap 172 for the chassis 100, the inside rollback sleeve 166, and the sensor 238. The end cap 172 has a substantially cylindrical portion 190 and a flange 194 extending laterally from one end of the cylindrical portion 190. The cylindrical portion 190 defines a bore 290 in which the inside rollback sleeve 166 is received. The rollback sleeve 166 is positioned in the end cap 172 with the camming elements 206 proximate to the front face 292 of the flange 194 of the end cap 172. The cylindrical portion 190 of the end cap 172 adjacent to the flange 194 may be a thicker section 294 than the remaining thinner section 296 of the cylindrical portion 190 distal from the flange 194. The thicker cylindrical section 294 defines the opening 240 in which the sensor is disposed. FIG. 12 shows that the volume behind the sensor 238 may be filled with epoxy 300 to secure the sensor 238 in place. Shoulders 302 are provided that establish a seat for the sensor 238 in the opening 240. The slot 214 is also provided for the solenoid support 212 to pass through the thinner cylindrical section 296 of the end cap 172.

Figure 9:
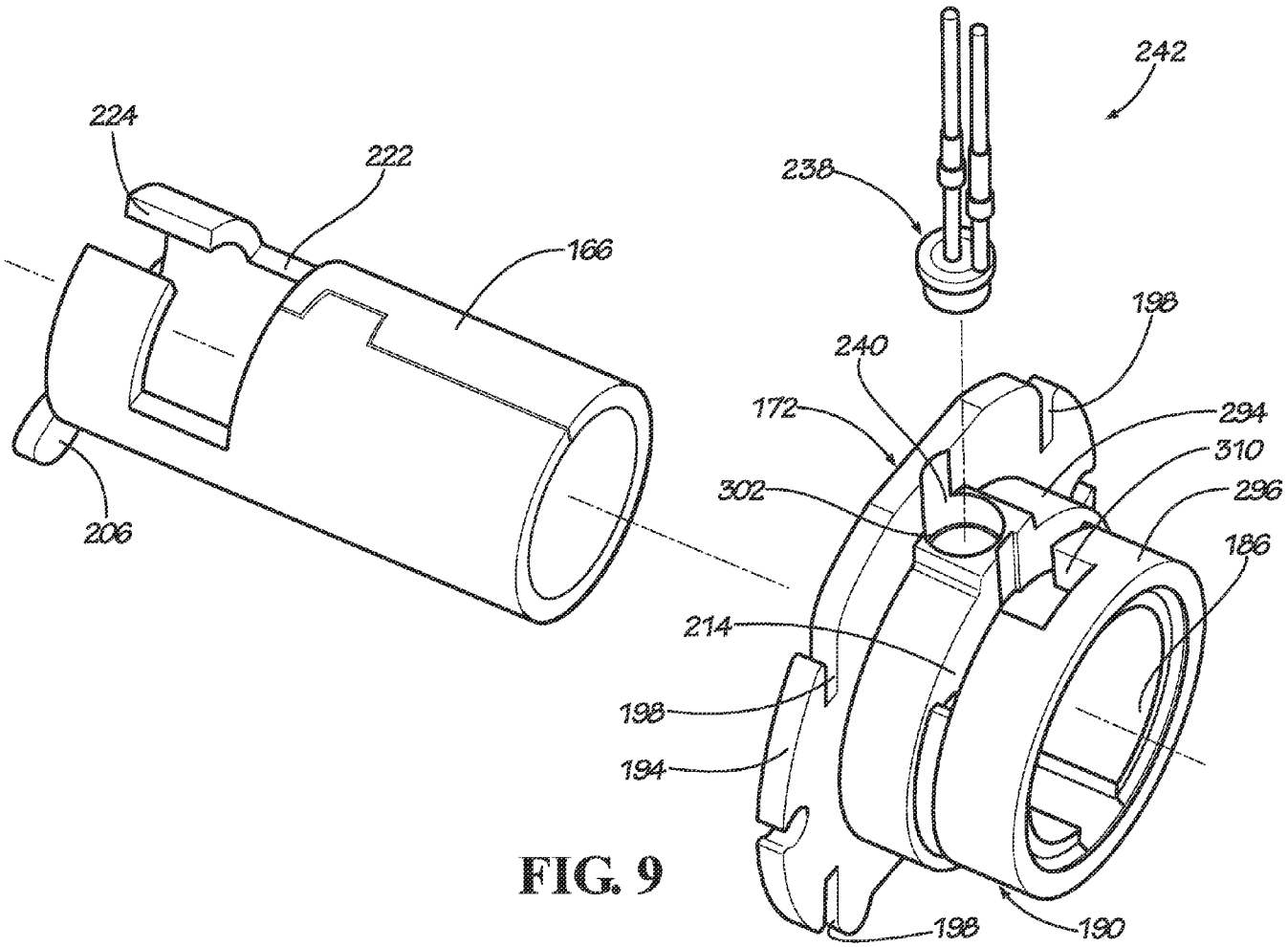
FIG. 9 is an exploded perspective view of the REX assembly shown in FIG. 7.
Figure 11:
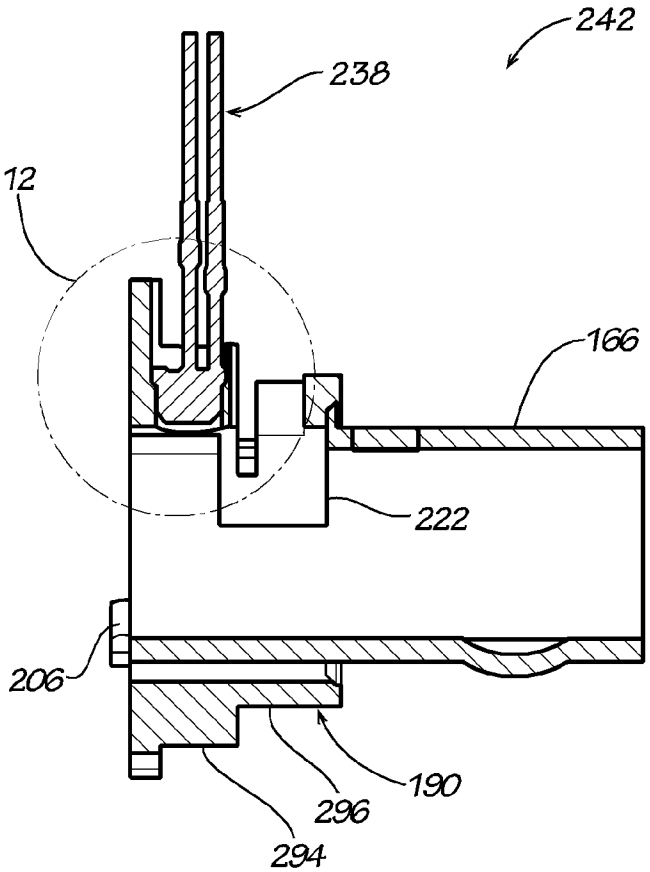
FIG. 11 is a longitudinal section view of the REX assembly shown in FIG. 7.
Figure 10:
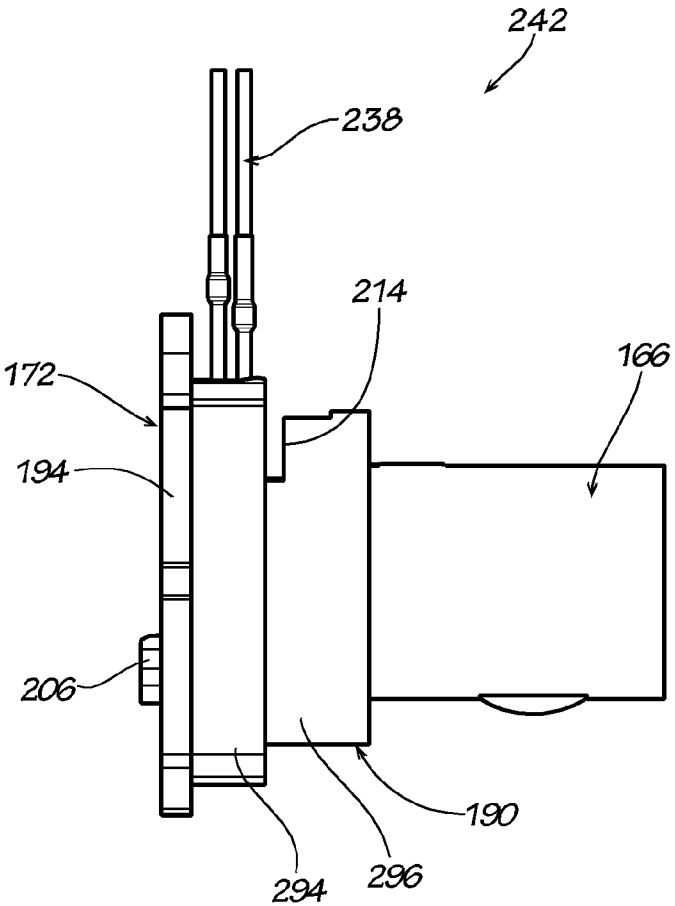
FIG. 10 is a side elevation view of the REX assembly shown in FIG. 7.

The inside rollback sleeve 166 defines the longitudinal slot 224 or window at the end of the rollback sleeve 166 near the camming elements 206. The solenoid 210 and associated elements are not shown in FIGS. 7-14, but as shown in FIG. 9, adjacent to the lateral slot 222 in the inside rollback sleeve 166 is the lateral slot 214 through which the solenoid support 212 passes. The electrical wire 228 (FIG. 4) extends through another opening 310 in the wall of the end cap 172. The positions and relative dimensions of the slots 214, 222, 224 could be different than that shown and still meet the intended purposes.

Figure 15:
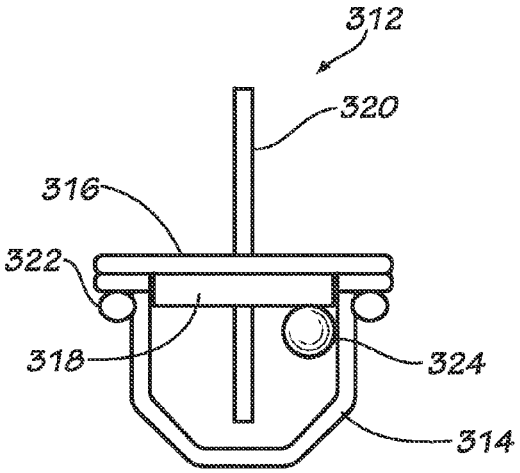
Prior Art FIG. 15
FIGS. 15-17 are exploded and assembled views of an embodiment of a prior art switch.
Figure 16:
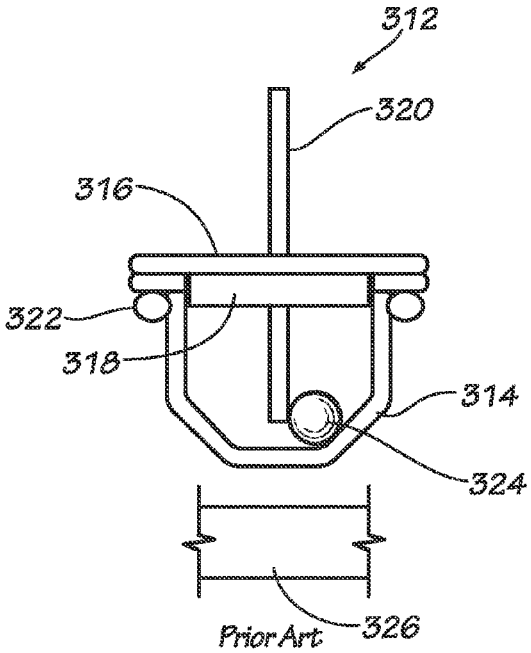
Prior Art FIG. 16
Figure 17:
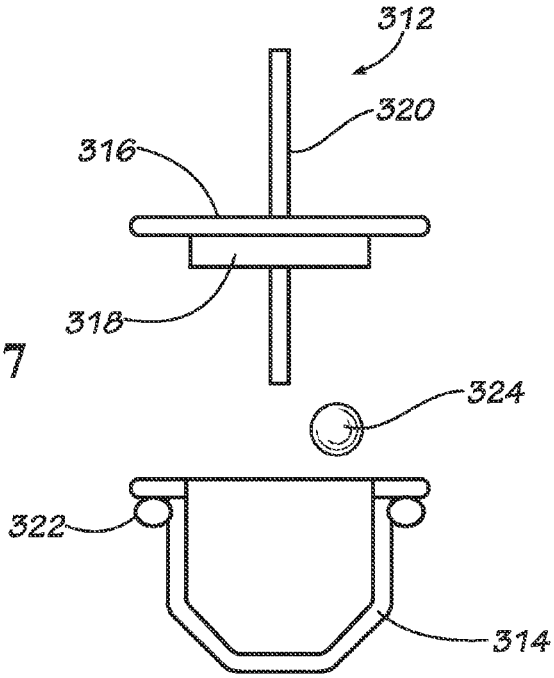
Prior Art FIG. 17

FIGS. 15-20 show an embodiment of the sensor 238 including a switch 312 portion of the sensor 238. The sensor 238 shown is capable of detecting ferrous metal within a certain range of distance, and the switch 312 may be a magnetic switch such as a Magnasphere® switch as shown in FIGS. 15-17, which is an N-series switch, particularly model MG-A2-1.5-N, manufactured by Magnasphere Corp. of Waukesha, Wis. Patents related to the Magnasphere® switch include U.S. Pat. Nos. 5,332,992, 5,530,428, 5,673,021, 5,977,873, 6,506,987, 6,603,378, 6,803,845, 7,023,308, 7,291,794, and RE39,731, the entire contents of all of which are hereby incorporated by reference.

The embodiment of the switch 312 of FIGS. 15-17 includes a metal housing 314, a metal cap 316, a ceramic insulator 318, a metal electrode 320, a ferro-magnetic bias 322, and a magnetic ball 324. In the open circuit condition shown in FIG. 15, the ball 324 is attracted to the ferro-magnetic bias 322. When ferrous metal 326, is placed in proximity to the switch 312 as shown in FIG. 16, the ball 324 is attracted to the ferrous metal 326 and moves to the free end of the switch 312. When the ball 324 moves to the end of the switch 312, the ball 324 closes the switch 312, completing a circuit between the metal housing 314 and the electrode 320.

Figure 19:
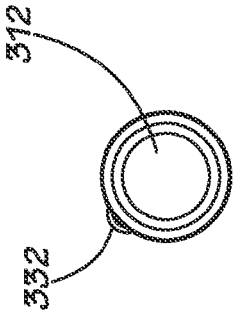
FIG. 19 is an end view of the REX sensor shown in FIG. 18.
Figure 18:
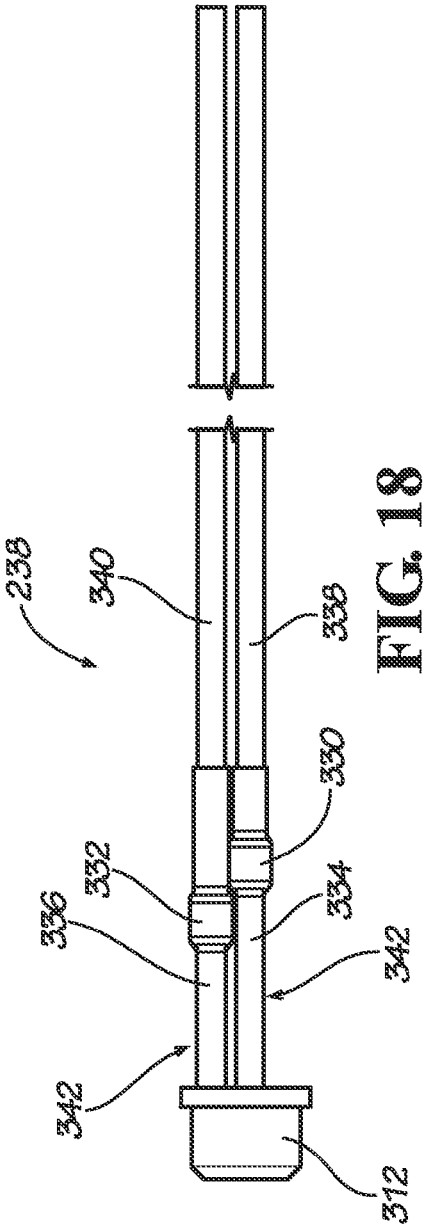
FIG. 18 is a side view of an embodiment of a REX sensor as shown in FIG. 4.
Figure 20:
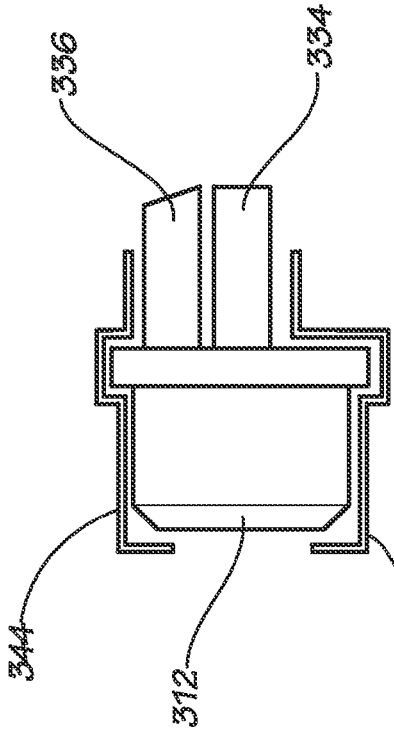

As shown in FIGS. 18-20, soldered areas 330, 332 may connect the switch wires 334, 336 from the switch 312 as provided by the manufacturer to wires 338, 340. One switch wire 334 may be electrically connected to the electrode 320, and the other switch wire 336 may be electrically connected to the metal housing 314. Wires 338, 340 may be, in one embodiment, AWG 28. FIG. 18 shows that individual shrink tube 342 may be provided on each wire 334, 336 to meet the switch 312 and extend in the other direction past the soldered areas 330, 332. The switch 312 also has shrink tube 344 around it except for the free end, as shown in FIG. 20. The shrink tube may be ¼-inch diameter, and, for example, with a 2:1 ratio of before to after shrinkage diameter.

Figure 23:
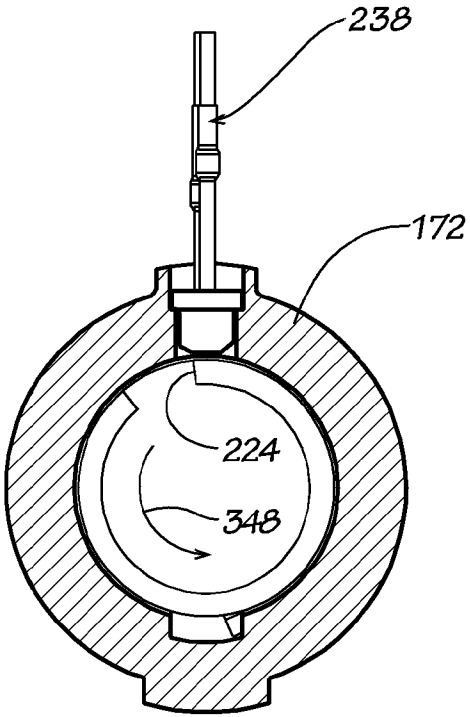
FIGS. 21-23 are cross-section views showing the operation of the REX assembly shown in FIG. 7.
Figure 22:
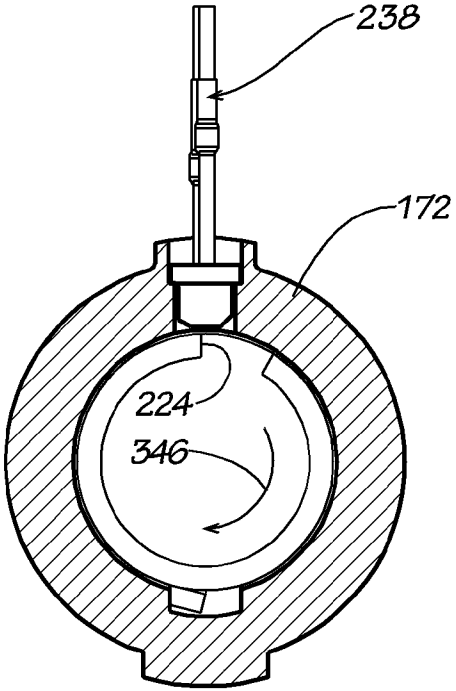
Figure 21:
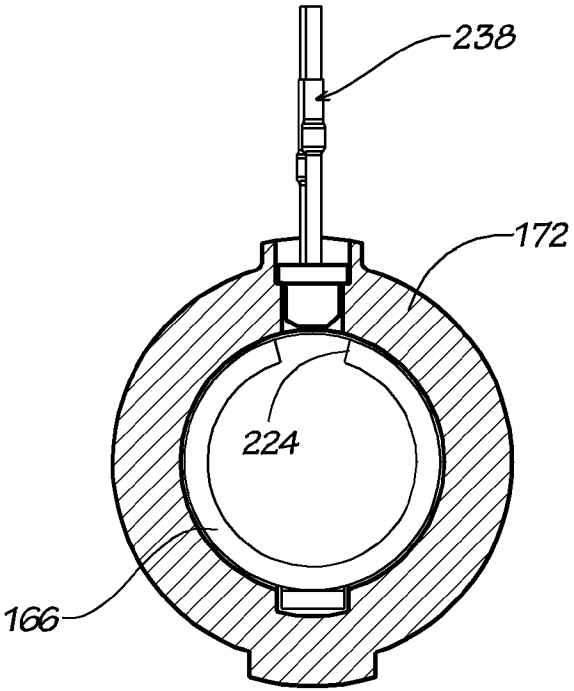

FIGS. 21-23 show how the sensor "sees" through the end cap 172 to detect when the longitudinal slot 224, which may also be considered a gap or window, in the rollback sleeve 166 has turned left or right. In FIG. 21, the latch operator 90 has not been engaged and the rollback sleeve 166 is in its home position, with the slot 224 in the rollback sleeve 166 at neutral. In this initial position, the opening 240 in the end cap 172 and the slot 224 in the rollback sleeve 166 are in substantial registration. There is no metal in the detection range of the sensor 238. In FIG. 22, the latch operator 90, and consequently the rollback sleeve 166, is rotated to the right 346, and in FIG. 23 the latch operator 90, and consequently the rollback sleeve 166, is rotated to the left 348. In both FIGS. 22 and 23, the wall of the rollback sleeve 166 is in registration with the opening 240 in the end cap 172, and the rollback sleeve 166 is within the detection range of the sensor 238. The sensor 238 is then actuated, closing the circuit to send the REX signal to the controller 58. The REX signal overrides the generation of an alarm signal in the controller, and the alarm does not sound when the door open signal is received (FIG. 1). The nature of operation of the sensor 238, in the depicted embodiment using a ball 324 to complete a circuit, and the orientation and position relative to the door plane, contribute to making the switch 312 difficult to defeat by a prospective intruder.

Figure 25:
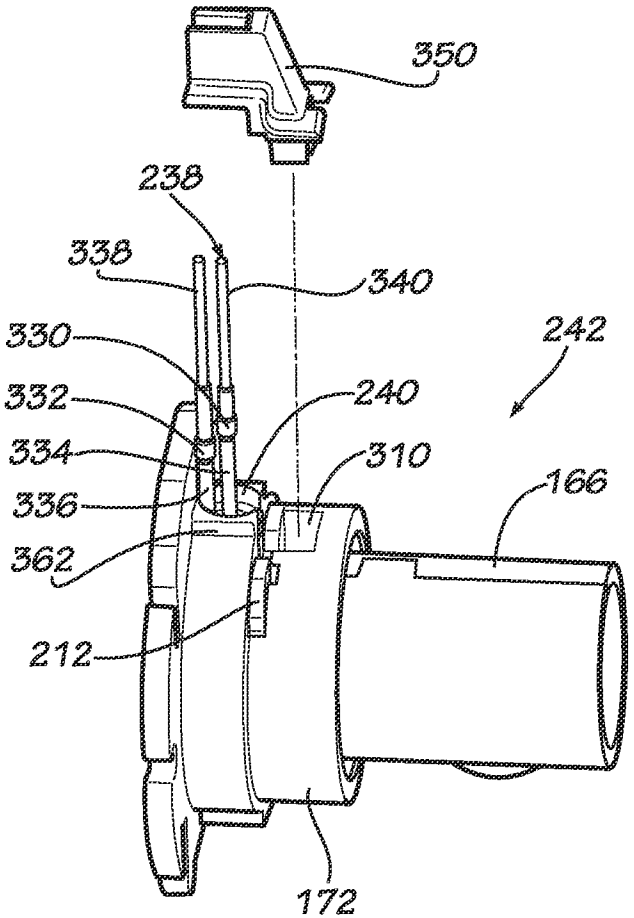
FIG. 25 is a partially exploded perspective view of the REX assembly and shield shown in FIG. 24.
Figure 24:
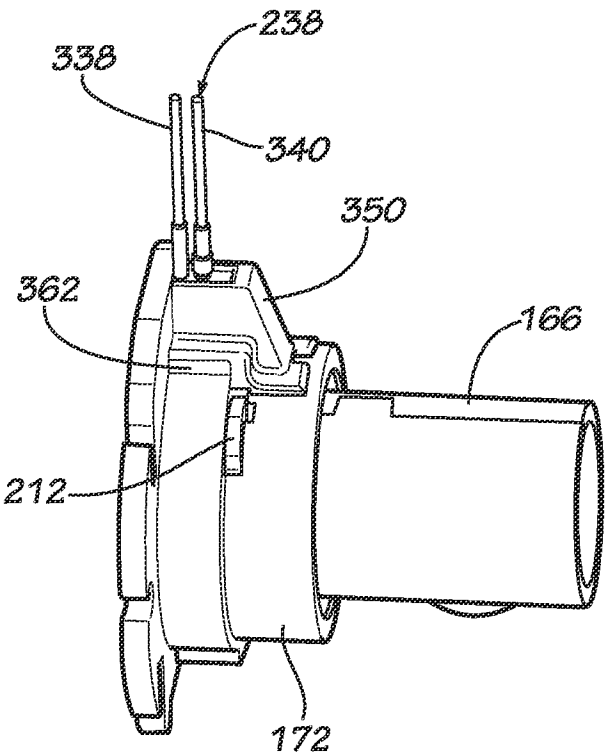
FIG. 24 is a perspective view of the REX assembly shown in FIG. 7 with an embodiment of a shield added.
Figure 26:
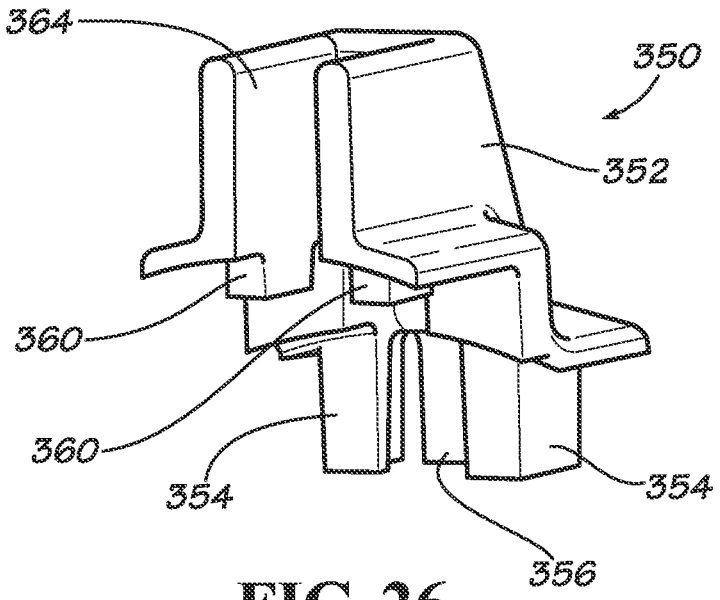
FIGS. 26 and 27 are front and rear perspective views of the shield shown in FIG. 24.
Figure 27:
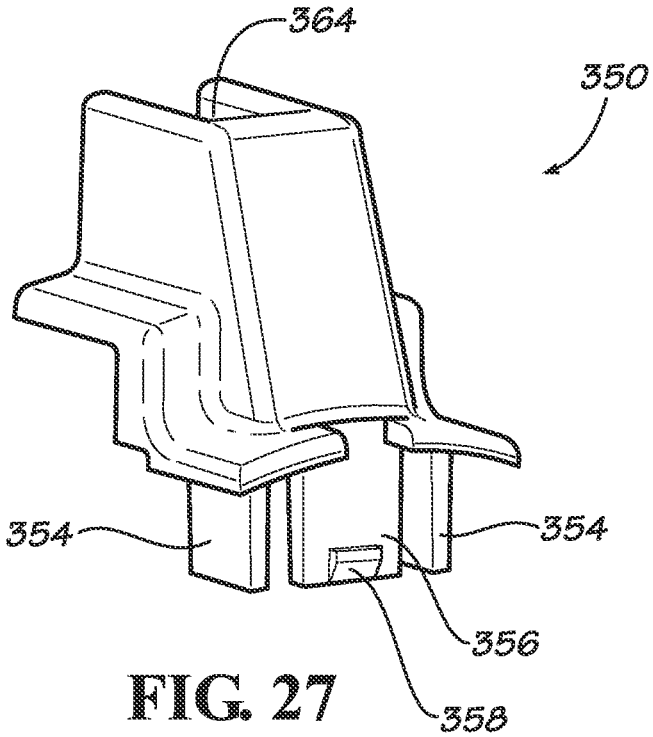

FIGS. 24 and 25 show the REX assembly 242 previously described with the solenoid support 212 included and a shield 350 added. The shield 350 is shown in detail in FIGS. 26 and 27. The shield 350 is configured to conform to the outside shape of the inside end cap 172 and the surround the switch wires 334, 336 at their attachment to the switch 312, and may extend as far or farther than the soldered areas 330, 332 to protect the connections of the switch wires 334, 336 to the switch 312 and the connections of the switch wires 334, 336 to the additional wires 338, 340. The embodiment of a shield 350 that is shown has a body 352 with feet 354 that extend into an opening 310 in the end cap 172 that provide lateral positioning of the shield 350. A tab 356 is provided that extends into the same opening 310, and has a locking element 358 that latches onto the inside surface of the end cap 172 to secure the shield 350 to the end cap 172. Two additional protrusions 360 overlap a raised portion 362 on the end cap 172. The switch wires 334, 336 pass through an opening 364 in the shield 350, along with the solenoid electrical wire 228 (not shown).

Although only a few exemplary embodiments have been shown and described in considerable detail herein, it should be understood by those skilled in the art that we do not intend to be limited to such embodiments since various modifications, omissions and additions may be made to the disclosed embodiments without materially departing from the novel teachings and advantages, particularly in light of the foregoing teachings. For example, although a cylindrical lock is shown, the novel REX assembly shown and described herein may be used with any type of latchset or lockset that has a detectible motion of internal parts associated with a door operator. It is envisioned that a variety of sensors and may be made to accommodate a variety of lock assemblies not discussed in detail herein. Accordingly, we intend to cover all such modifications, omission, additions and equivalents as may be included within the spirit and scope as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A door lockset assembly operable with a latch operator and a controller, the door lockset assembly comprising:

a mounting member adapted to be in a fixed position in the door lockset, wherein the mounting member is a hollow member with a substantially cylindrical inside surface defining a substantially cylindrical opening and including a wall defining a first void extending radially therethrough;

a rotatable member adapted to rotate in response to rotation of the latch operator, wherein the rotatable member is a hollow substantially cylindrical member including a wall defining a second void extending radially therethrough; and a sensor mounted to the mounting member within the first void, spaced from the rotatable member, and configured to detect rotation of the rotatable member.

2. The door lockset assembly of claim 1, wherein:

a portion of the rotatable member is received in the mounting member substantially cylindrical opening and the first and second voids are substantially in initial registration;

and the sensor is adapted to activate upon rotation of the rotatable member that results in the second void not being in registration with the first void and the wall of the rotatable member being detectable by the sensor.

3. The door lockset assembly of claim 2, wherein a shoulder is disposed in the first void, the shoulder forms a seat, and the sensor is mounted in the seat.

4. The door lockset assembly of claim 1, wherein the sensor comprises a magnet.

5. The door lockset assembly of claim 1, wherein the sensor comprises a magnetic sphere.

6. The door lockset assembly of claim 5, wherein the sensor further comprises a metal housing and a metal electrode, wherein when the sensor detects the rotatable member, the magnetic sphere contacts the housing and the electrode to close a circuit and send a request to exit signal to the door lockset controller.

7. The door lockset assembly of claim 1, wherein the sensor includes a switch and when the sensor detects the rotatable member, the switch closes to complete a circuit and send a request to exit signal to the door lockset controller.

8. A lock assembly for a door operable with a latch operator and a controller, the lock assembly comprising:

a rollback sleeve having a first end and a second end, the rollback sleeve including a substantially cylindrical wall portion and defining a void in the wall proximate to the first end, wherein the rollback sleeve is adapted to be operatively connected to a door operator and to rotate upon rotation of the latch operator;

an end cap receiving the rollback sleeve, the end cap including a flange extending from a substantially cylindrical wall portion, the cylindrical wall portion of the end cap defining an opening, wherein the opening in the wall of the first end cap is in substantial initial registration with the void in the wall of the first rollback sleeve; and a sensor disposed in the opening in the wall of the end cap, wherein the sensor is adapted to activate upon rotation of the rollback sleeve that results in the opening in the wall of the end cap not being in registration with the void in the wall of the rollback sleeve and the wall of the rollback sleeve being detectable by the sensor.

9. The lock assembly of claim 8, wherein the sensor does not contact the first rollback sleeve.

10. The lock assembly of claim 8, wherein the sensor comprises a magnet.

11. The lock assembly of claim 8, wherein the sensor comprises a magnetic sphere.

12. The lock assembly of claim 11, wherein the sensor further comprises a metal housing and a metal electrode, wherein when the sensor detects the rollback sleeve, the magnetic sphere contacts the housing and the electrode to close a circuit and send a request to exit signal to the door lockset controller.

13. The lock assembly of claim 8, wherein the sensor includes a switch and when the sensor detects the rollback sleeve, the switch closes to complete a circuit and send a request to exit signal to the door lockset controller.

14. The lock assembly of claim 8, wherein the sensor comprises wires extending through the opening in the wall of the end cap, and further comprising a shield releasably mounted to the end cap and extending around the wires proximate to the end cap.

15. A chassis for a door lockset operable with latch operators on each side of a door and a controller, the chassis comprising:

a housing having a first side and a second side opposite the first side;

a retractor disposed in the housing including a cam surface on each side;

first and second rollback sleeves each having a first end and a second end, and each rollback sleeve including a substantially cylindrical wall portion and camming elements extending from the first end of the cylindrical portion, the camming elements engageable with the cam surfaces of the retractor, the first rollback sleeve defining a void in the wall proximate to the first end, wherein the first and second rollback sleeves are adapted for each to be operatively connected to a latch operator and to rotate upon rotation of the respective latch operator;

a first end cap mounted to the first side of the housing and receiving the first rollback sleeve, the first end cap including a flange extending from a substantially cylindrical wall portion, the cylindrical wall portion of the first end cap defining an opening, wherein the opening in the wall of the first end cap is in initial substantial registration with the void in the wall of the first rollback sleeve;

a second end cap mounted to the second side of the housing and receiving the second rollback sleeve, the second end cap including a flange extending from a substantially cylindrical wall portion; and a sensor disposed in the opening in the wall of the first end cap, wherein the sensor is adapted to activate upon rotation of the first rollback sleeve that results in the opening in the wall of the first end cap not being in registration with the void in the wall of the first rollback sleeve and the wall of the first rollback sleeve being detectable by the sensor.

16. The chassis of claim 12, wherein the sensor does not contact a moving part in the chassis.

17. The sensor assembly of claim 15, wherein the sensor comprises a magnet.

18. The sensor assembly of claim 15, wherein the sensor comprises a magnetic sphere.

19. The sensor assembly of claim 18, wherein the sensor further comprises a metal housing and a metal electrode, wherein when the sensor detects the rollback sleeve, the magnetic sphere contacts the housing and the electrode to close a circuit and send a request to exit signal to the door lockset controller.

20. The sensor assembly of claim 15, wherein the sensor includes a switch and when the sensor detects the rollback sleeve, the switch closes to complete a circuit and send a request to exit signal to the door lockset controller.

21. The sensor assembly of claim 15, wherein the sensor comprises wires extending through the opening in the wall of the first end cap, and further comprising a shield releasably mounted to the end cap and extending around the wires proximate to the first end cap.

22. A method of making a sensor assembly for a door lockset operable with a latch operator and a controller, the method comprising:

providing a mounting member adapted to be in a fixed position in the door lockset, wherein the mounting member is a hollow member with a substantially cylindrical inside surface defining a substantially cylindrical opening and including a wall defining a first void extending radially therethrough;

providing a rotatable member adapted to rotate in response to rotation of the latch operator, wherein the rotatable member is a hollow substantially cylindrical member including a wall defining a second void extending radially therethrough; and mounting a sensor to the mounting member within the first void, spaced from the rotatable member, and configured to detect rotation of the rotatable member.

23. A method of generating a request to exit signal with a door lockset operable with a latch operator and a controller, the door lockset including:

a rollback sleeve having a first end and a second end, the rollback sleeve including a substantially cylindrical wall portion and defining a void in the wall proximate to the first end, wherein the rollback sleeve is adapted to be operatively connected to a door operator and to rotate upon rotation of the latch operator;

an end cap receiving the rollback sleeve, the end cap including a flange extending from a substantially cylindrical wall portion, the cylindrical wall portion of the end cap defining an opening, wherein the opening in the wall of the first end cap is in initial registration with the void in the wall of the first rollback sleeve; and a sensor disposed in the opening in the wall of the end cap, the method comprising:

actuating the sensor in response to a magnetic attraction of a component of the sensor to the rollback sleeve when the rollback sleeve is rotated to cause the wall of the rollback sleeve to be disposed in registration with the opening in the wall of the first end cap, and sending a request to exit signal to the controller.

* * * * *